US007028620B1

(12) United States Patent
Lyndon

(10) Patent No.: US 7,028,620 B1
(45) Date of Patent: Apr. 18, 2006

(54) SHELVING SYSTEM

(75) Inventor: Maynard Hale Lyndon, The Sea Ranch, CA (US)

(73) Assignee: Design Ideas, Ltd., Springfield, IL (US)

( * ) Notice: Subject to any disclaimer, the term of this patent is extended or adjusted under 35 U.S.C. 154(b) by 0 days.

(21) Appl. No.: 11/026,690

(22) Filed: Dec. 30, 2004

(51) Int. Cl.
*A47B 91/00* (2006.01)

(52) U.S. Cl. ..... 108/190; 108/180; 108/153.1

(58) Field of Classification Search ..... 108/159, 108/180, 185, 153.1, 190, 192; 211/189
See application file for complete search history.

(56) References Cited

U.S. PATENT DOCUMENTS

| | | | | | |
|---|---|---|---|---|---|
| 193,339 | A | | 7/1877 | Lothrop | |
| 2,529,649 | A | * | 11/1950 | Coplen | 108/190 |
| 2,973,232 | A | * | 2/1961 | Knoll | 108/92 |
| 3,180,288 | A | | 4/1965 | McCowan | |
| 3,307,505 | A | * | 3/1967 | Windross | 108/180 |
| 3,338,647 | A | * | 8/1967 | Schreyer | 312/194 |
| 3,730,601 | A | | 5/1973 | Misenheimer, III | |
| 3,783,801 | A | * | 1/1974 | Engman | 108/60 |
| 4,073,241 | A | * | 2/1978 | Wheeler | 108/91 |
| 4,102,275 | A | * | 7/1978 | Spound et al. | 108/92 |
| 4,418,627 | A | | 12/1983 | Baker | |
| 4,560,215 | A | * | 12/1985 | Turner | 312/223.3 |
| 5,709,441 | A | | 1/1998 | Bartling et al. | |
| 5,746,139 | A | * | 5/1998 | Villanueva | 108/92 |
| 5,810,505 | A | * | 9/1998 | Henriott et al. | 403/230 |
| 5,909,863 | A | | 6/1999 | Mansfield et al. | |
| 5,941,183 | A | * | 8/1999 | Ming-Shun | 108/153.1 |
| 6,123,035 | A | * | 9/2000 | Pfister | 108/180 |
| 6,764,144 | B1 | * | 7/2004 | Insalaco et al. | 312/108 |

* cited by examiner

*Primary Examiner*—Jose V. Chen
(74) *Attorney, Agent, or Firm*—Saidman DesignLaw Group

(57) ABSTRACT

The present disclosure is directed to a modular shelving system for supporting various objects such as home furnishings, books, artistic objects, and the like. The shelving system includes a generally horizontal panel supported by a support assembly that includes a panel and at least one rod. In one example, the shelving system can be moved between first and second arrangements. In the first arrangement, at least two of the support assembly panels are aligned and in the second arrangement at least two of the support assembly panels are unaligned. The shelving system is easily moved between the disassembled and assembled state.

15 Claims, 8 Drawing Sheets

SHELVING SYSTEM

BACKGROUND OF THE INVENTION

1. Field of the Invention

The present invention relates to a shelving system. More particularly, the present invention relates to modular shelving systems that have a unique support assembly and that can be formed into various arrangements.

2. Description of Related Art

Shelving systems are well known pieces of furniture. They are useful in organizing, for example, office and home items, such as books and artistic objects like statues and vases. Some shelving systems are simple bookcases that are constructed by the manufacturer not to be disassembled. These systems are often large and bulky pieces of furniture that must be delivered to the end user via a truck, which is sometimes undesirable as it is costly and time consuming.

Some other shelving systems are designed to be changed and rearranged by the user. One such modular shelving system is disclosed in U.S. Pat. No. 5,909,863 to Mansfield et al., which discloses a shelving system including shelf boards, support tubes, and cross piece members. The shelf boards are located horizontally and are supported by a plurality of support tubes. The cross members extend between pairs of support tubes to provide additional structural stability to the shelf unit assembly. All of the vertical load bearing members or support tubes are identical with the same geometry and material. In addition, the cross members have a utilitarian look.

Similarly, U.S. Pat. No. 193,339 to Lothrop, U.S. Pat. No. 3,180,288 to McCowan, U.S. Pat. No. 4,418,627 to Baker, and U.S. Pat. No. 5,709,441 to Bartling et al. disclose shelving systems with identical supports.

U.S. Pat. No. 3,730,601 to Misenheimer, III discloses an alternative furniture assembly using identical plastic tubular members or spacers as the support structures. The spacers are connected to the shelves using studs. Although the assembly of Misenheimer, III includes vertical wall members of wood, cardboard, pressed board, or the like, these members are not structural, i.e., load bearing members as are shelves, studs, and spacers.

A manufacturer of furniture is always keen for new design ideas that help to distinguish the manufacturer's product from those of others. When such design distinctiveness can be combined with functional advantages, it is particularly advantageous. Thus, a need exists for a shelving system that is modular, sturdy, easy to assemble and disassemble, inexpensive to ship, and minimizes storage needs when disassembled, while also providing a unique look and aesthetic appeal.

SUMMARY OF THE INVENTION

The present invention is directed to a modular shelving system that is easily assembled and disassembled and that can be set up in a variety of different arrangements. According to one example of the present invention, the shelving system comprises at least two shelving units. Each shelving unit includes a first panel and a support assembly. The support assembly includes first and second support members removably joined to the first panel such that the first and second support members support the first panel. That is the first and second support members are load-bearing or structural members. The first support member is formed of a first material and the second support member is formed of a second material different from the first material. In an assembled state, one shelving unit is vertically stacked upon the other shelving unit to form an upper shelving unit supported by a lower shelving unit.

According to one feature of the present invention, the first material is wood and the second material is metal.

According to another feature of the present invention, the first support member is formed in a first shape, and the second support member is formed in a second shape different from the first shape. As a result, the first and second support members have different geometries. In such an example, the first shape can be a panel and the second shape can be a rod.

According to another example of the present invention, the shelving system comprises at least two shelving units. Each shelving unit includes a first panel and a support assembly. The support assembly includes a second panel and at least one rod. The second panel and the at least one rod are removably joined to the first panel such that the second panel and the at least one rod support the first panel. In an assembled state, one shelving unit is vertically stacked upon the other shelving unit to form an upper shelving unit supported by a lower shelving unit.

According to one aspect of the present invention, an unassembled volume of the shelving system is significantly less than an assembled volume of the shelving system.

According to another aspect of the present invention, the first panel has a first set of panel bores near a first edge for joining the second panel thereto and the first panel has a first set of rod bores near a second edge for joining the at least one rod thereto.

According to yet another aspect of the present invention, the first panel has a second set of panel bores near the second edge for joining the second panel thereto and the first panel has a second set of rod bores near the first edge for joining the at least one rod thereto, such that a user can select the arrangement of the support assembly for each shelving unit.

According to one feature of the present invention, the first panel has a generally horizontal orientation and each second panel has a generally vertical orientation.

According to another feature of the present invention, the first and second panels are formed of wood. According to yet another feature of the present invention, the support assembly further includes a second rod. In such an example, the rods may be formed of metal.

According to another feature of the present invention, in each shelving unit an opening extends between the at least one rod and the second panel.

In another example of the present invention, the shelving system may further include at least three shelving units.

According to one aspect of the present invention, each first panel may have the same width. Alternatively, at least two of the first panels may have different widths.

According to one aspect of the present invention, in a first arrangement each of the second panels is near the first edge. Alternatively, in a second arrangement one of the second panels is near the first edge and the other second panel is near the second edge, wherein the shelving system is movable or may be alternated between the first and second arrangements.

According to another example of the present invention, the shelving system comprises at least two shelving units. Each shelving unit includes a first panel and a support assembly. The first panel includes a first edge and a spaced apart second edge. The support assembly includes a second panel and at least one rod. The second panel and the at least one rod are removably joined to the first panel such that the second panel and the at least one rod support to the first panel. The shelving system is movable or may be alternated between first and second arrangements. In the first arrangement each of the second panels is near the first edge. In the second arrangement, one of the second panels is near the first edge and the other second panel is near the second edge.

BRIEF DESCRIPTION OF THE DRAWINGS

The present invention will be more fully appreciated as the same becomes understood from the following detailed description of the best mode presently contemplated for carrying out the present invention when viewed in conjunction with the accompanying drawings, in which.

DETAILED DESCRIPTION OF EXAMPLES OF THE PRESENT INVENTION

Figure 1:
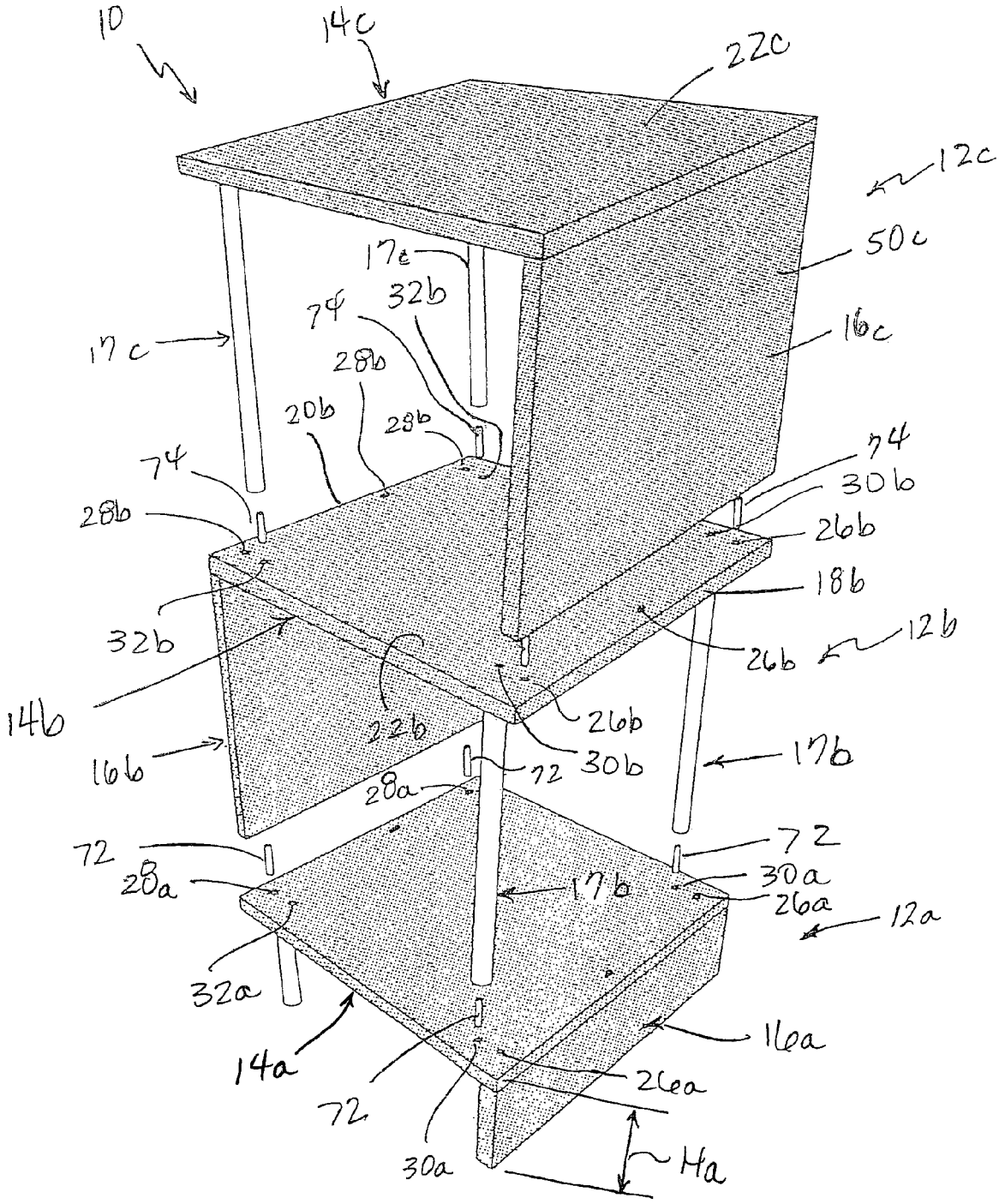
FIG. 1 is a partially, exploded, perspective view of a first example of a shelving system of the present invention.
Figure 2:
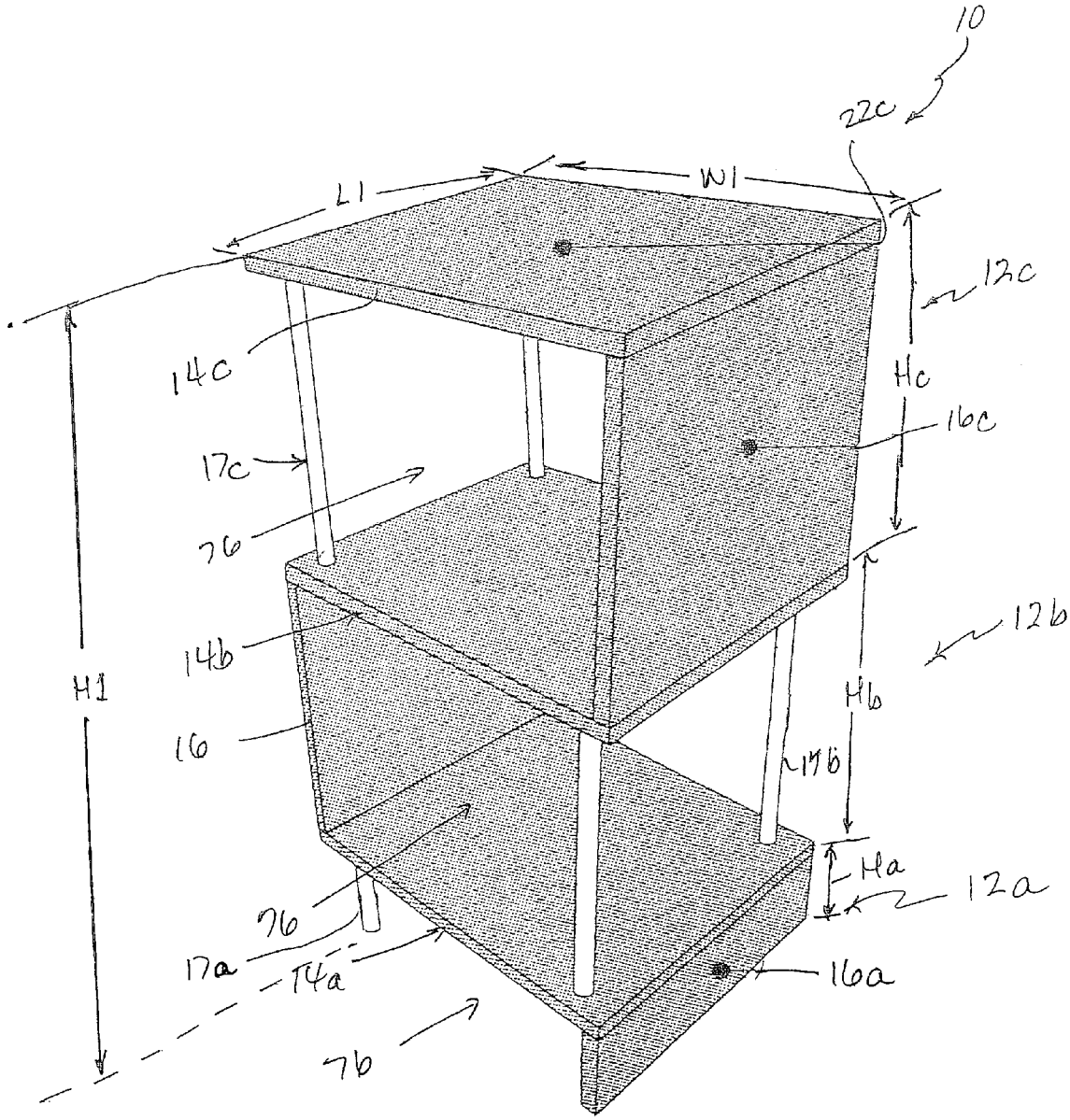
FIG. 2 is a perspective view of the shelving system of FIG. 1, wherein the system is assembled.

FIGS. 1 and 2 show a first example of shelving system 10 that includes three shelving units or modules 12*a*–*c*. First shelving unit 12*a* is the base or lowermost shelving unit. Second shelving unit 12*b* is the intermediate shelving unit, and third shelving unit 12*c* is the uppermost shelving unit.

Exemplary shelving unit 12*b* includes first panel 14*b* supported by a support assembly including first support member 16*b* and second support members 17*b*. The support assembly is structural, i.e., load bearing.

First panel 14*b* is generally horizontally oriented in an assembled state. First panel 14*b* includes first edge 18*b* and spaced apart second edge 20*b*, as well as upper surface 22*b* and lower surface 24*b* opposite thereto (See FIG. 3). Upper surface 22*b* includes first or outer set of panel arrangement bores 26*b* near first edge 18*b* and second or outer set of panel arrangement bores 28*b* near second edge 20*b*. In the present example, first and second sets of arrangement bores 26*b* and 28*b* include three such bores, but in an alternative example the middle bore can be eliminated.

In the present example, panel 14*b* is formed of wood. Panel 14*b* may further include a wood core covered with veneers, as known by those of ordinary skill in the art. The present invention is not limited to these materials.

Upper surface 22*b* further includes third or inner set of rod arrangement bores 30*b* near first edge 18*b* and inwardly spaced from bores 26*b*. Upper surface 22*b* includes fourth or inner set of rod arrangement bores 32*b* near second edge 20*b* and inwardly spaced from second set of bores 28*b*.

Figure 3:
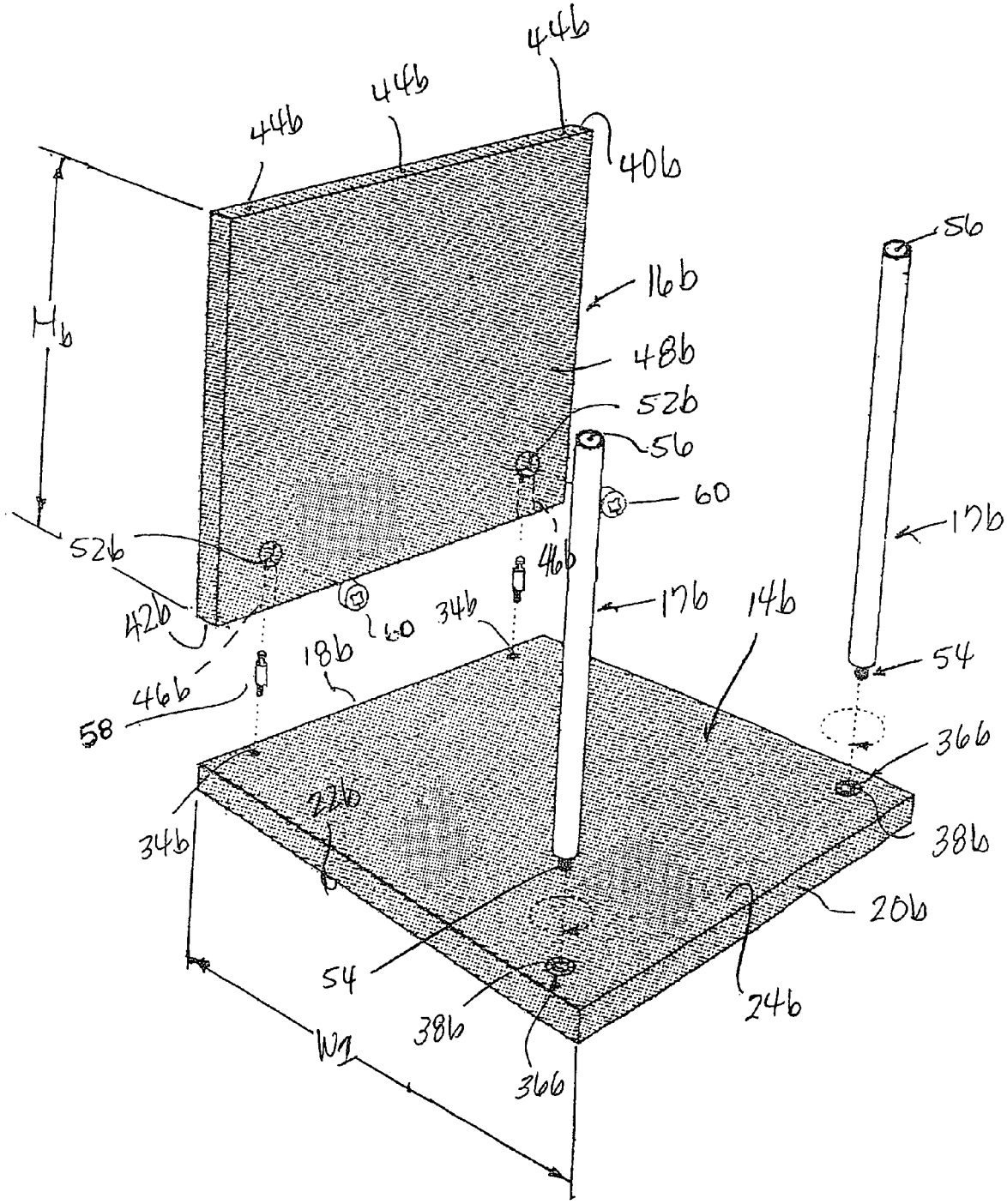
FIG. 3 is an exploded, perspective view of a first example of a shelving unit for use in the shelving system of FIG. 1, wherein the shelving unit is oriented for assembly.

As best shown in FIG. 3, lower surface 24*b* of panel 14*b* includes a pair of connector or cam bolt bores 34*b* near first edge 18*b* and a pair of receptacles 36*b* with a threaded central bore 38*b* near second edge 20*b*.

First and second support members 16*b* and 17*b* are generally vertically oriented in an assembled state. First support member 16*b* in the present example is a panel including first edge 40*b* and second edge 42*b*. First edge 40*b* includes a fifth set of arrangement bores 44*b*. In the present example, fifth set of bores 44*b* includes three such bores, but in an alternative example the middle bore can be eliminated. In the present example, fifth set of arrangement bores 44*b* and first and second sets of arrangement bores 26*b* and 28*b* are arranged so that in assembled state fifth set of bores 44*b* align with either first or second set of arrangement bores 26*b* or 28*b* depending on the arrangement of shelving system 10, as discussed below.

Second edge 42*b* of support member 16*b* includes a pair of cam bolt bores 46*b* (shown in phantom). In the present example, cam bolt bores 46*b* and cam bolt bores 34*b* are arranged so that in assembled state bores 46*b* align with bores 34*b*.

Referring to FIG. 3, first support member 16*b* further includes inner surface 48*b* and opposite outer surface (represented by outer surface 50*c* of support member 16*c* in FIG. 2). Inner surface 48*b* defines a pair of cam lock recesses 52*b* that are in communication with cam bolt bores 46*b*. In the present example, outer surface 50*c* is flat and unobstructed by recesses or bores.

Referring again to FIG. 3, second support members 17*b* in the present example are a pair of rods. Each rod or support member 17*b* includes one threaded end 54 and an opposite attachment end, which defines attachment bore 56. In the present example, shelving assembly 10 is configured and dimensioned so that so that in its assembled state, when rods 17*b* are attached to panel 14*b*, bores 56 align with either third or fourth sets of arrangement bores 30*b* or 32*b* depending on the arrangement of shelving system 10, as discussed below.

In the present example, first support member 16*b* is formed of a first material and second support members 17*b* are formed of a second material different from the first material. More specifically, the first material is wood, such as plywood and the second material is metal, such as a hollow stainless steel tube. Additionally, first support member 16*b* may further include a wood core covered with veneers, as known by those of ordinary skill in the art. In the present example, panel 14*b* and first support member 16*b* are of the same material. The present invention is not limited to these materials. For example, the second material can also be plastic.

In the present example, first support member 16*b* is formed in a first shape and second support members 17*b* are formed in a second shape different from the first shape. More specifically, the first shape is a square panel with a rectangular cross-section, and the second shape is cylindrical or tubular with a circular cross-section. Alternatively, the second support members may have another cross-sectional shape such as square, rectangular, triangular or the like. The dimensions of the first and second support members can vary depending on the aesthetic desires and load-bearing needs of the shelving system.

Referring again to FIG. 3, shelving unit 12*b* has height $H_b$ as defined by the dimensioning of first and second support members 16*b* and 17*b*. Shelving unit has a width W1 as defined by the dimensioning of panel 14*b*.

Figure 4:
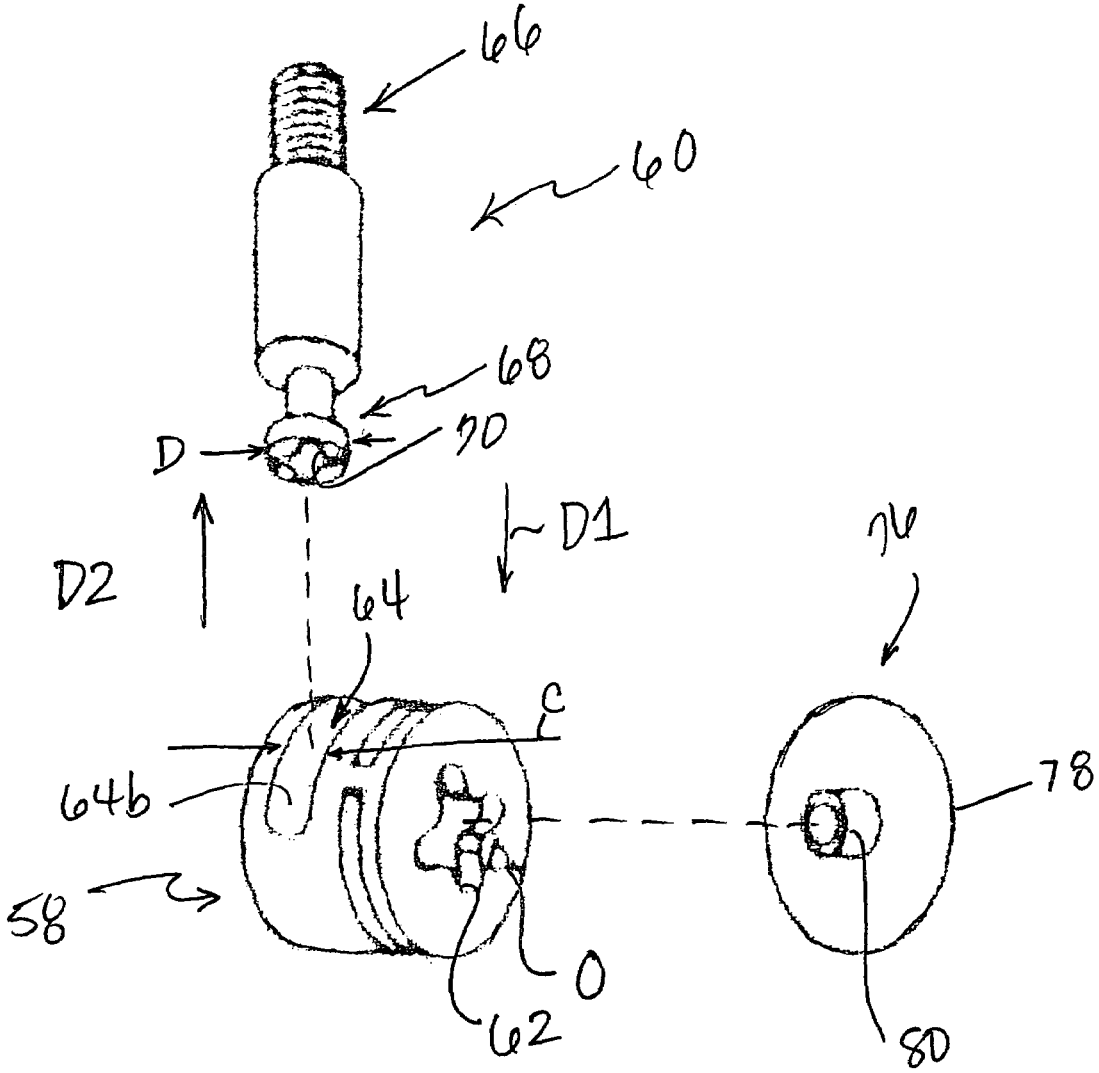
FIG. 4 is an exploded, perspective view of a connector and a connector cover for use in the shelving system of FIG. 1.

In order to assemble shelving unit 12*b*, various connectors are used. These connectors removably join first and second support members 16*b* and 17*b* to panel 14*b*. In the present example, the connectors are selected so that minimal tooling, such as only a Phillips screwdriver, is necessary to assemble the shelving unit. With reference to FIGS. 3 and 4, the connectors include commercially available cam bolts 58 and cam locks 60.

Each cam lock 58 includes patterned recess 62 for receiving the tip of a Phillips screwdriver and cam recess 64. Each cam bolt 60 includes threaded end 66 and bolt head 68. Bolt head 68 includes patterned recess 70 for receiving the tip of a Phillips screwdriver. Cam lock 58 is paired up with cam bolt 60 so that bolt head 68 is received in cam recess 64 during assembly. Cam recess 64 has an enlarged portion (not shown) with a width C greater than bolt head 68 diameter D to allow entry of bolt head 68 in direction D1. Cam lock 58 further includes an orientation mark O for properly orienting cam lock 58 during assembly so that enlarged portion can receive bolt head 68.

Upon rotation of cam lock 58 about 180 degrees using cam recess 64 and a screwdriver, cam lock 58 and cam bolt 60 lockably engage due to cam recess 64 which narrows into an narrowed portion 64*b* (visible in FIG. 4) with a width C less than bolt head 68 diameter D so that bolt head 68 is retained within cam lock 60 from movement in direction D2.

Referring to FIG. 2, shelving units 12*a* and *c* are similar to shelving unit 12*b*, except height $H_a$ of first shelving unit 12*a* is less than the height $H_b$ and $H_c$ of second and third shelving units 12*b* and 12*c*.

Referring to FIG. 1, in the present example shelving unit 12*c* has generally horizontal panel 14*c* with upper surface 22*c* which does not include alignment bores 26*b*, 28*b*, 30*b*, and 32*b* so that it is smooth. However, providing a horizontal panel 14*c* with a smooth upper surface for the top of shelving unit 12*c* is optional.

Assembly of shelving unit 12*b* will now be discussed with reference to FIG. 3. First, generally horizontal panel 14*b* is placed on a flat surface, such as the floor or a table, with upper surface 22*b* facing downwardly. Next, second support members 17*b* are removably joined to panel 14*b* by rotating each threaded end 54 into each threaded bore 38*b* of receptacles 36*b*. As a result, second support members 17*b* are removably joined to panel 14*b* and oriented about normally to panel 14*b*.

Then, cam bolts 60 are joined to panel 14*b* by rotating each threaded end 66 (See FIG. 4) into each cam bolt bore 34*b* using patterned recess 70 and a screwdriver. As a result, cam bolts 60 are removably joined to panel 14*b* and oriented about normally to panel 14*b*.

Referring to FIGS. 3 and 4, first support member 16*b* is placed on a flat surface, such as the floor or a table, with inner surface 48*b* facing upwardly. Next, cam locks 58 are inserted into cam lock recesses 52*b* in first support member 16*b* so that orientation mark O is pointing toward edge 42*b*. As a result, enlarged portion of cam recess 64 is in communication with cam bolt bores 46*b* (shown in phantom in FIG. 3). Next, first support member 16*b* is positioned generally normal to panel 14*b* and moved toward panel 14*b* so that bolt heads 68 of cam bolts 60 pass through cam bolt bores 46*b* (shown in phantom) and into cam recess 64 of cam locks 58. Next, each cam lock 60 is rotated using patterned recess 62 and a screwdriver so that bolt head 68 moves into narrow portion 64*b* of cam recess 64 and cam bolts 58 are in a locked state so that they cannot be removed from cam locks 60 without rotating cam locks 60 back to their original position. As a result, first support member 16*b* is removably joined to panel 14*b* and oriented about normally to panel 14*b*.

Shelving units 12*a* and 12*c* are similarly assembled. Then shelving units 12*a*–12*c* are vertically stacked upon one another to form upper shelving units supported by lower shelving units. With reference to FIG. 1, second shelving unit 12*b* is stacked upon first shelving unit 12*a* and pins 72 are used to join these units together. Third shelving unit 12*c* is stacked upon second shelving unit 12*b* and 74 are used to join these units together. In the present example, pins 72 and 74 are stainless steel.

Referring to FIGS. 1 and 3, in order to form the first arrangement shown, where first support member 16*b* is unaligned with first support member 16*a*, pins 72 are disposed in second set of alignment bores 28*a* and in fifth alignment bores 44*b* of first support member 16*b*. In addition, pins 72 are disposed in third set of alignment bores 30*a* and in alignment bores 56 of second support members 17*b*. In addition in the first arrangement, first support member 16*c* is aligned with first support member 16*a*. This results from pins 74 being disposed in first set of alignment bores 26*b* and in fifth alignment bores (similar to bores 44*b*) of first support member 16*c*. In addition, pins 74 are disposed in fourth set of alignment bores 32*b* and in alignment bores 56 of second support members 17*c*. Thus, creating the alternating arrangement shown in FIG. 1. Shelving system 10 includes three generally horizontal shelves 14*a*–14*c* and there are openings 76 (See FIG. 2) extending between second support members 17*a*–17*c* and first support member 16*a*–16*c* for each shelving unit 12*a*, 12*b*, 12*c*.

Referring to FIGS. 1 and 4, shelving system 10 may further include a plurality of cam lock covers 76 that include head 78 and outwardly extending stem 80. Head 78 has a diameter sufficient to cover cam lock 58 when stem 80 is inserted within patterned recess 62. Covers 76 may be colored to match the material of first support member 16*b* so that each cam lock 58 is concealed and shelving system 10 has an aesthetically pleasing look.

Figure 5:
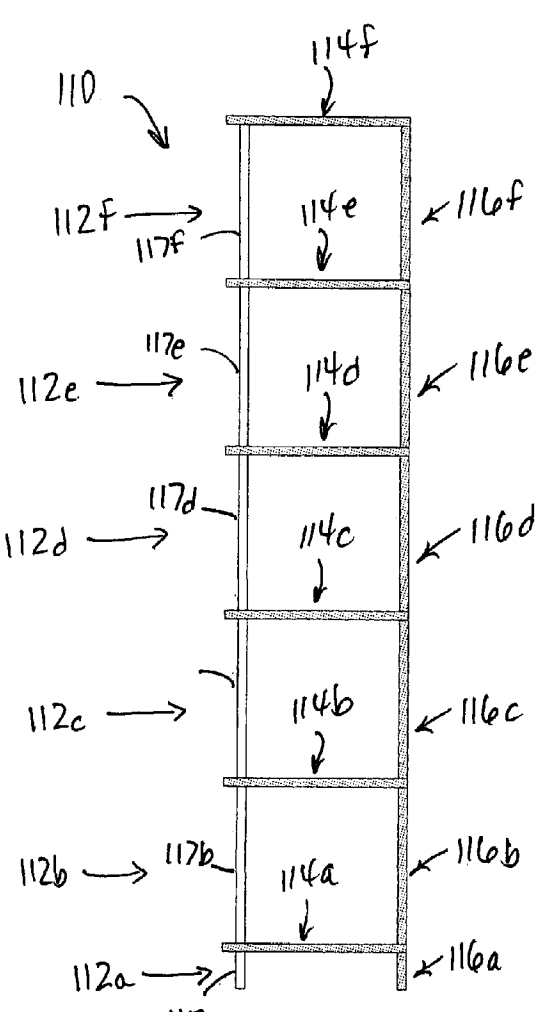

Referring to FIG. 5, an example of another shelving system 110 is shown which is similar to shelving unit 10. Shelving unit 110 includes six shelving units 112*a*–112*f* so that six generally horizontal panels 114*a*–*f* are included. Additionally shelving system 110 has a different arrangement from shelving unit 10. First support members 116*a*–*f* are aligned with one another on the right side of system 110 and the pairs of second support members 117*a*–*f* are aligned with one another on the left side of system 110. This arrangement is achieved by using only inner attachment bores 32*a* (See FIG. 1) to connect second support members 117*b*–*f* and by using only outer attachment bores 26*a* (See FIG. 1) to connect first support members 116*b*–*f*. Shelving system 10 can also be arranged in this manner.

Figure 6:
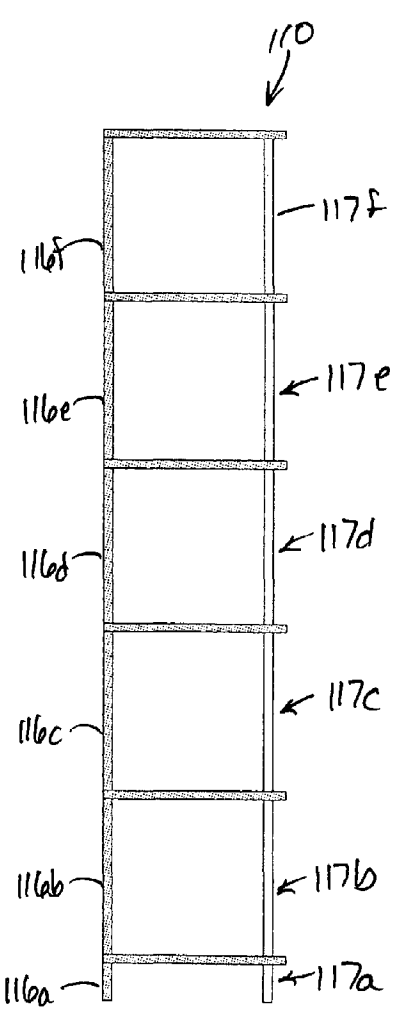

Referring to FIG. 6, shelving system 110 is shown is shown in a different arrangement from FIG. 5. First support members 116*a*–*f* are aligned with one another on the left side of system 110 and pairs of second support members 117*a*–*f* are aligned with one another on the right side of system 110. This arrangement is achieved by using only sets of outer attachment bores 28*a* (See FIG. 1) to connect the first support members 116*b*–*f* and by using only third sets of inner attachment bores 30*a* (See FIG. 1) to connect second support members 117*b*–*f*. Shelving system 10 can also be arranged in this manner.

Figure 7:
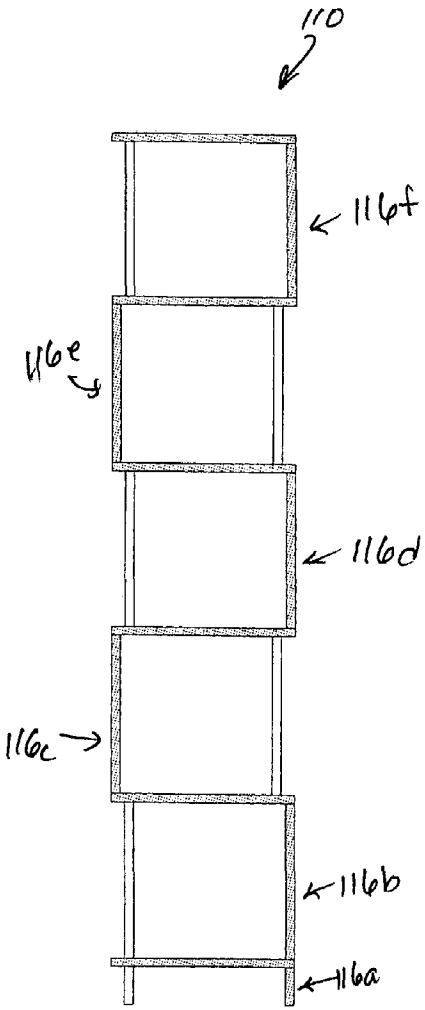
FIGS. 5–7 are front views of various arrangements of second examples of a shelving system of the present invention.

Referring to FIG. 7, shelving unit 110 is shown is shown in an alternating arrangement similar to FIG. 2 except first support members 116*a* and 116*b* are aligned. Shelving system 110 as shown in FIG. 7 is assembled similar to shelving system 10.

Figure 8:
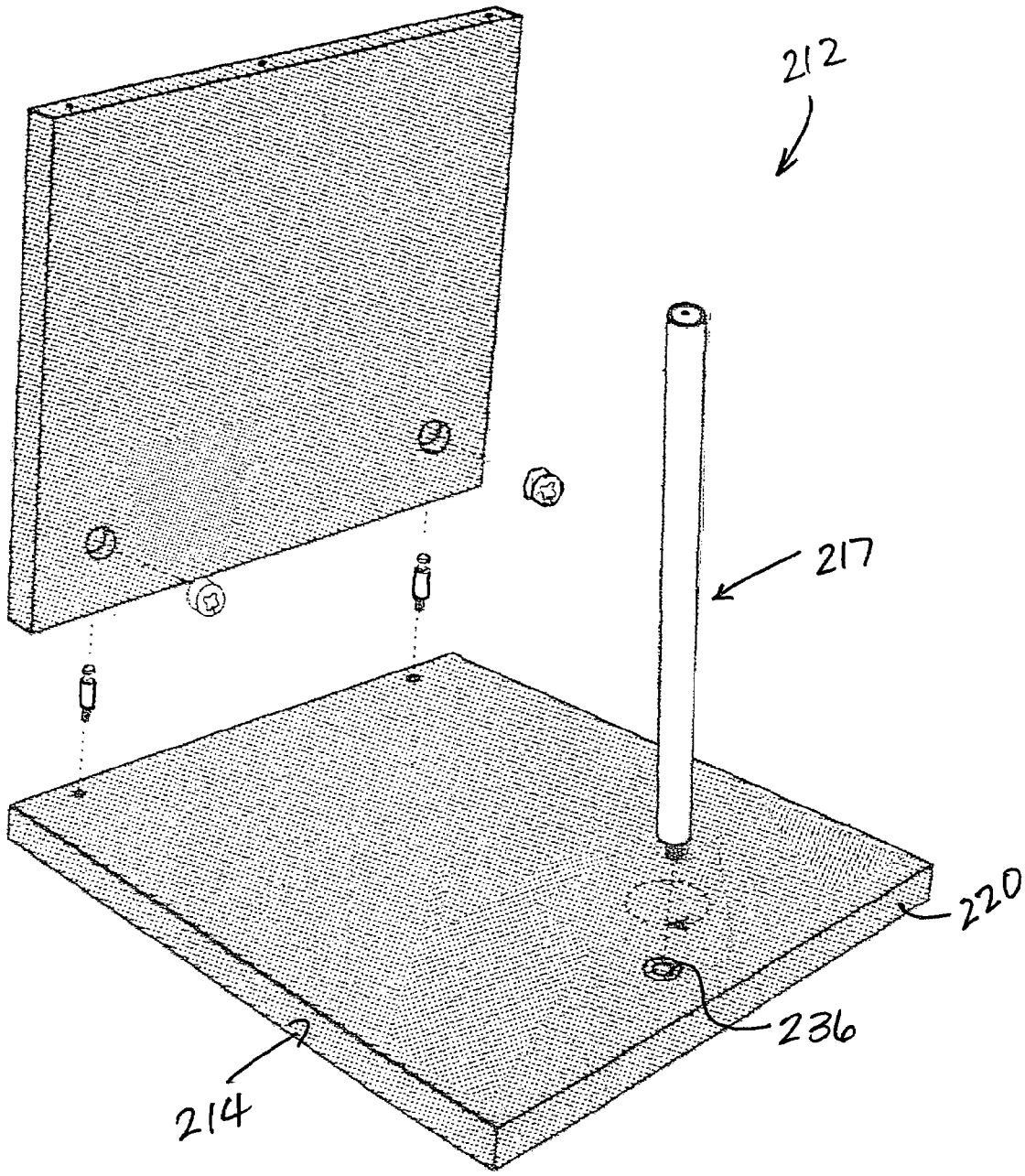
FIG. 8 is an exploded, perspective view of an alternative example of a shelving unit for use in a shelving system of the present invention, wherein the shelving unit is oriented for assembly.

Referring to FIG. 8, an alternative example of a shelving unit 212 is shown. Shelving unit 212 is similar to shelving unit 12*b* (shown in FIG. 3) except it includes only one second support member 217 located centrally near second edge 220 of generally horizontal panel 214. Generally horizontal panel 214 has been further modified to include only one receptacle 236 for use with second member 217. Multiple shelving units 212 can be used to form a multi-tiered shelving system in various arrangements or shelving units 212 can be used with shelving units 12*a–c* to form an alternative shelving system.

Figure 9:
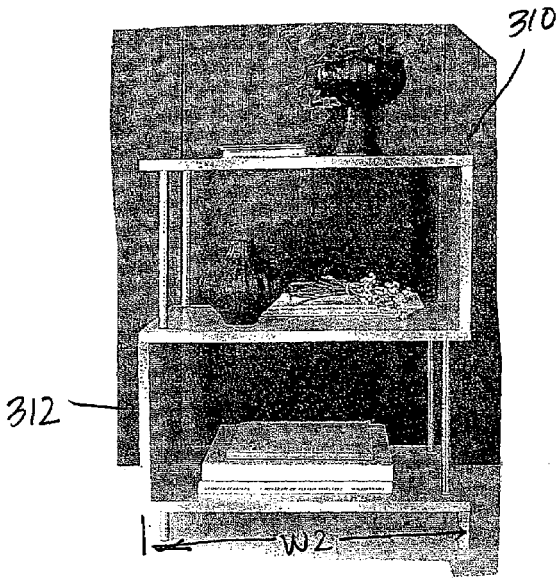
FIGS. 9–11 are front views of various alternative examples of shelving systems of the present invention.

FIG. 9 shows 3-shelf shelving system 310 with shelving units having width W2 greater than width W1 (See FIG. 3) of shelving units 12*a–c*. Otherwise shelving units 312 used to form shelving system 310 are similar to shelving units 12*a–c* and various arrangements of shelving system 310 can be created as previously discussed. In an alternative example, shelving unit 312 with width W2 can be combined with shelving unit 12*b* with width W1.

Figure 10:
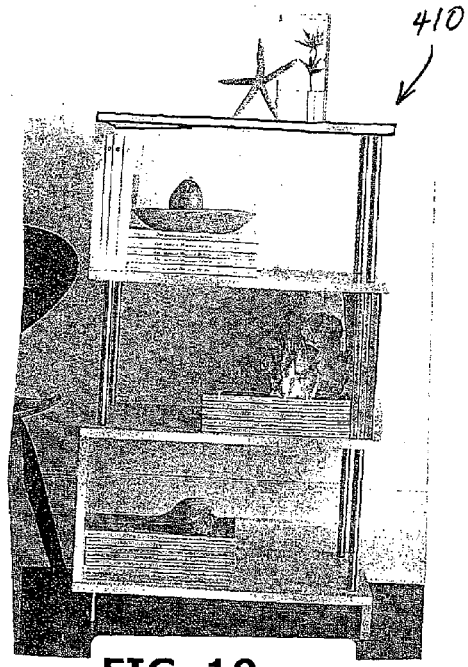

FIG. 10 shows 4-shelf shelving system 410 with shelving units with width similar to shelving system 310. Otherwise the shelving units used to form shelving system 410 are similar to shelving units 12*a–c*, and various arrangements of shelving system 410 can be created as previously discussed.

Figure 11:
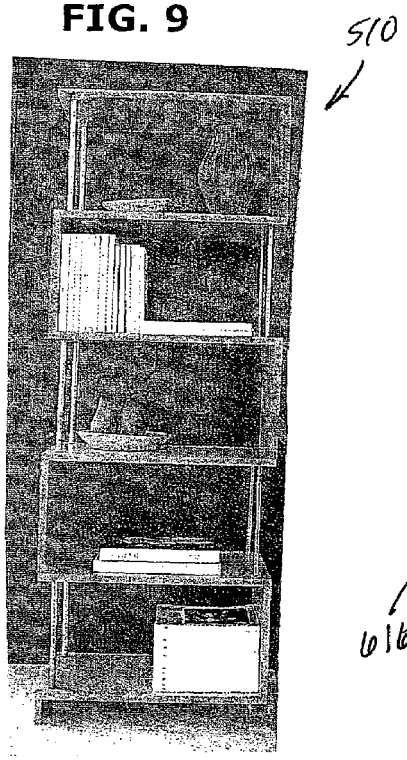

FIG. 11 shows 6-shelf shelving system 510 with shelving units with width similar to shelving system 310. Otherwise the shelving units used to form shelving system 510 are similar to shelving units 12*a–c*, and various arrangements of shelving system 510 can be created as previously discussed.

Figure 12:
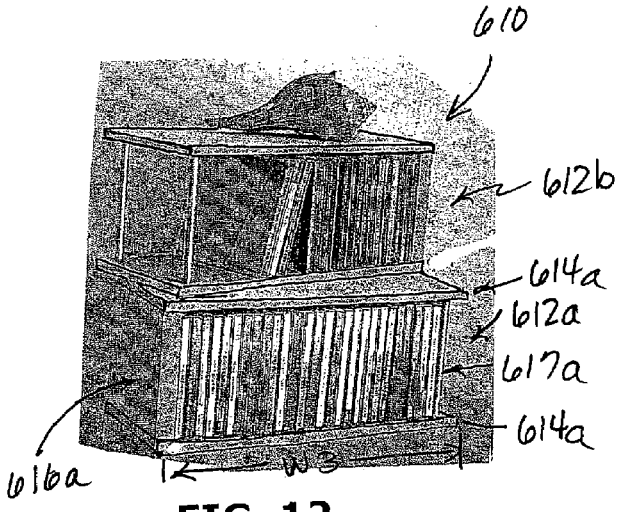
FIG. 12 is a perspective view of yet another alternative example of shelving system of the present invention.

FIG. 12 shows shelving system 610 with shelving units 612*a,b* having width W3 less than width W1 (See FIG. 3) of shelving units 12*a–c*. Shelving units 612*a,b* also have height H3 less than height $H_b$ (See FIG. 3) of shelving units 12*a–c*. Shelving units 612*a,b* are sized to hold compact disks. Shelving unit 612*a* includes a pair of generally horizontal panels 614*a* removably joined to first and second support members 616*a*, 617*a* as previously discussed. In this example, shelving units 612*a* and 612 are not connected together using pins, as previously discussed, but are free standing units. Alternatively, panels 614*a* can be modified to include pin holes for securing units 614*a, b* together. In yet another alternative example, units 612*a,b* can use only one horizontal panel 614*a* and be configured and arranged like previously discussed systems.

Alternatively, shelving systems of the present invention can have numerous other arrangements such as only two first support members being aligned and the rest unaligned and these first support members being in various shelving units either adjacent to one another (as units 116*a,b* shown in FIG. 7) or these aligned shelving units can be spaced from one another. The arrangement is only limited by the user's imagination and the number of shelving units.

Shelving systems of the present invention 10, 110, 310, 410, 510, and 610 further include the characteristic of having an unassembled volume of that is significantly less than an assembled volume. As a result, the unassembled state facilitates shipping and storage of all the parts of the shelving system in a relatively flat box or container.

Figure 13:
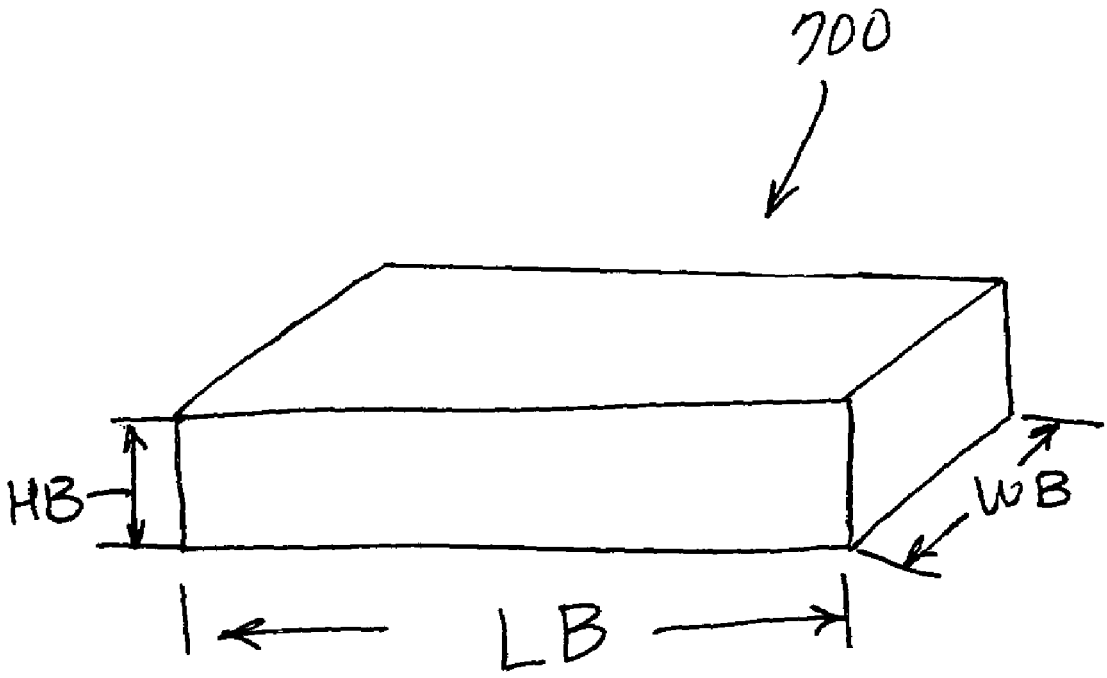
FIG. 13 is a schematic, perspective view of a box for use in shipping and storing the shelving systems of the present invention in a disassembled state.

By way of example, the assembled volume of 3-shelf shelving system 10 is with reference to FIG. 2, total height H1 (about 35.5 inches) times width W1 (about 16 inches) times length L1 (about 16 inches). Thus, the assembled volume is about 9088 cubic inches. FIG. 13 shows box 700 for receiving, for example, shelving system 10 in a disassembled state. The disassembled or unassembled volume of 3-shelf shelving system 10 is about the volume of box 700 which is calculated by multiplying box height HB (about 7.7 inches) times box width WB (about 18.5 inches) times box length LB (about 18.7 inches). Thus, the disassembled volume is about 2664 cubic inches, which is significantly less than the assembled volume of 9088 cubic inches.

The table below shows the dimensions and the assembled and disassembled/unassembled volumes for various shelving systems.

| Shelving System | Assembled Dimensions | Dis-assembled or Box Dimensions | Assembled Volume | Dis-assembled or Box Volume |
|---|---|---|---|---|
| 4-shelf shelving system with units 12b | H ≈ 51.5"<br>W ≈ 16"<br>L ≈ 16" | H ≈ 9.4"<br>W ≈ 18.5"<br>L ≈ 18.7" | ≈ 13184 $in^3$ | ≈ 3252 $in^3$ |
| 6-shelf shelving system 110 | H ≈ 83.5"<br>W ≈ 16"<br>L ≈ 16" | H ≈ 7.9"<br>W ≈ 18.5"<br>L ≈ 33.9" | ≈ 21376 $in^3$ | ≈ 4954 $in^3$ |
| 3-shelf shelving system 310 | H ≈ 28.5"<br>W2 ≈ 24"<br>L ≈ 13" | H ≈ 5.8"<br>W ≈ 15.6"<br>L ≈ 26.6" | ≈ 8892 $in^3$ | ≈ 2407 $in^3$ |
| 4-shelf shelving system 410 | H ≈ 41"<br>W2 ≈ 24"<br>L ≈ 13" | H ≈ 7.6"<br>W ≈ 15.6"<br>L ≈ 26.6" | ≈ 12792 $in^3$ | ≈ 3154 $in^3$ |
| 6-shelf shelving system 510 | H ≈ 66"<br>W2 ≈ 24"<br>L ≈ 13" | H ≈ 10.3"<br>W ≈ 15.6"<br>L ≈ 26.6" | ≈ 20592 $in^3$ | ≈ 4274 $in^3$ |

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims. Therefore, this invention is not to be limited to the specific examples depicted therein. For example, the features of one example disclosed above can be used with the features of another example.

Further, the purpose of the Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

I claim as my invention:

1. A shelving system comprising:

a first shelving unit including a first shelf;

a first panel joined to one end of said first shelf such that said first panel supports said first shelf; and a first rod joined to an opposite end of said first shelf such that said first rod supports said first shelf; and a second shelving unit including a second shelf;

a second panel joined to one end of said second shelf such that said second panel supports said second shelf; and a second rod joined to an opposite end of said second shelf such that said second rod supports said second shelf; said first shelving unit supports said second shelving unit vertically stacked on said first shelving unit and said first rod is unaligned with said second rod.

2. The shelving system of claim 1, further including a third shelving unit.

3. The shelving system of claim 1, wherein each of said first shelf and said second shelf have the same width.

4. The shelving system of claim 1, wherein each of said first shelf and said second shelf have different widths.

5. The shelving unit of claim 1, wherein said first shelf and said second shelf each include two free edges such that said first panel is out of contact with said free edges of said first shelf and said second panel is out of contact with said free edges of said second shelf.

6. The shelving unit of claim 1, wherein one free edge of said first shelf is adjacent with the outer surface of said first panel and one free edge of said second shelf is adjacent with the outer surface of said second panel.

7. The shelving unit of claim 1, wherein said free edges of said first shelf and said free ends of said second shelf are smooth.

8. The shelving system of claim 1, wherein said first and second panels are formed of a first material and said first and second rods are formed of a second material, and the first material is wood and the second material is metal.

9. The shelving system of claim 1, wherein said first shelf has a first set of panel bores near the first edge for joining the first panel thereto and said first shelf has a first set of rod bores near the second edge for joining the first rod thereto.

10. The shelving system of claim 1, wherein said first shelf has a second set of panel bores near the second edge for joining the first panel thereto and said first shelf has a second set of rod bores near the first edge for joining the first rod thereto, such that a user can select the arrangement of the support assembly for each shelving unit.

11. The shelving system of claim 10, wherein each of said first shelf and said second shelf have different widths.

12. A shelving system comprising:

a first shelving unit including a first shelf with a first end and an opposite second end;

a first panel joined to said first shelf near said first end such that the first panel supports said first shelf; and a first rod joined to said first shelf near said second end such that said first rod supports said first shelf;

a second shelving unit including a second shelf with a third end and an opposite fourth end;

a second panel joined to said second shelf near said fourth end such that the second panel supports said second shelf; and a second rod joined to said second shelf near said third end such that said second rod supports said second shelf; said second shelving unit is vertically stacked on and supported by said first shelving unit such that said first end of said first shelf is closer to said third end of said second shelf than said fourth end of said second shelf.

13. The shelving system of claim 12, wherein said first and second panels are formed of wood and said first and second rods are formed of metal.

14. The shelving system of claim 13, wherein each of said first shelf and said second shelf have the same width.

15. A shelving system comprising:

a plurality of adjacent shelving units, each shelving unit including a shelf including a first end and an opposed second end;

a panel joined to said shelf near said first end such that the panel supports said shelf; and a rod joined to said shelf near said second end such that said rod supports said shelf; said shelving units are vertically stacked such that said panel and said rod of one of said shelving units is in contact with said shelf of the adjacent shelving unit and adjacent shelving units are diametrically rotated with respect to one another.

* * * * *